United States Patent [19]

Matson

[11] Patent Number: 5,040,315

[45] Date of Patent: Aug. 20, 1991

[54] ICE SCARIFYING ATTACHMENT

[76] Inventor: Gary D. Matson, 3420 23rd Ave. South, Minneapolis, Minn. 55407

[21] Appl. No.: 542,265

[22] Filed: Jun. 22, 1990

[51] Int. Cl.[5] ..... E01H 5/09; A01D 75/00

[52] U.S. Cl. ..... 37/223; 37/243; 37/DIG. 3; 56/295; 56/DIG. 9

[58] Field of Search ..... 56/295, 17.5, 255, 400, 56/DIG. 9; 172/111, 794; 299/24, 41; 37/219–223, 243, 233; 15/79.2

[56] References Cited

U.S. PATENT DOCUMENTS

| | | | |
|---|---|---|---|
| 2,859,581 | 11/1958 | Kroll et al. | 56/295 |
| 2,863,162 | 12/1958 | Draughon | 15/79 |
| 2,920,436 | 1/1960 | Benson | 56/295 |
| 2,975,579 | 3/1961 | Balkus et al. | 56/295 X |
| 2,983,057 | 5/1961 | Erickson | 37/243 |
| 2,984,919 | 5/1961 | Stoddard | 37/243 |
| 3,724,182 | 4/1973 | Long et al. | 56/295 X |
| 3,753,338 | 8/1973 | Sherratt | 56/295 X |
| 3,775,878 | 12/1973 | Beckner | 37/233 |
| 3,916,607 | 11/1975 | Howard | 56/295 X |
| 3,918,242 | 11/1975 | Harris | 56/295 X |
| 3,964,243 | 6/1976 | Knipe | 56/295 X |
| 4,409,781 | 10/1983 | Blackstone | 56/295 |
| 4,610,129 | 9/1986 | Bolger et al. | 56/295 X |
| 4,719,743 | 1/1988 | Bokon | 56/294 |

OTHER PUBLICATIONS

W. F. Laverty, Winter Sand Ingestion as it Affects Aircraft Engine Deterioration, Pratt & Whitney, Aug. 3, 1989.

*Primary Examiner*—Stephen J. Novosad
*Attorney, Agent, or Firm*—Faegre & Benson

[57] ABSTRACT

An ice scarifying tool replaces the grass cutting blade of a conventional rotary-type power lawn mower, so that, as the mower is operated over icy surface and the tool rotates in a plane substantially parallel to an icy ground surface, depending fingers chip and scarify the surface to provide improved traction thereon. The tool comprises a support plate which may be in the shape of a substantially rectangular elongate bar, a disc or a cruciform. Coiled ice scarifying fingers are attached to the plate. An ice scarifying tip at the distal end of each finger extends groundward from the support plate. A bag attachment or auxiliary blower may be provided for removal of the chipped ice, or it may be removed by power sweeper or plow.

8 Claims, 4 Drawing Sheets

ICE SCARIFYING ATTACHMENT

FIELD OF THE INVENTION

This invention relates to an ice scarifying attachment for use with a conventional rotary-type power lawn mower. The attachment comprises a horizontally rotatable support plate, such as an elongate bar or a circular disk, to be attached to the drive shaft of the lawn mower for circular rotation thereby in a plane parallel to a ground surface. Depending groundward from the support plate are a plurality of resilient fingers, each formed with a proximal end for attachment to the support plate, an intermediate coil portion by which the resilient finger is supported on a retention means on the support plate and a distal ice scarifying ground contacting tip. By operating a lawn mower with this novel ice scarifying attachment over icy outdoor traffic surfaces, such as sidewalks, driveways, airport runways, and the like, increased traction of the surface is achieved. This ice scarifying attachment is particularly intended for ice management on airport runways. Current use of sand and ice melting chemicals on airport surfaces permits suction of these materials into sensitive aircraft engines, resulting in costly and potentially dangerous wear and damage thereto.

BACKGROUND OF THE INVENTION

Ice covered surfaces are treacherous for foot, vehicular and ground aircraft traffic. The use of traction-increasing particulate, such as sand or grit, or ice-melting materials, such as salt or chemicals, is disadvantageous due to cost, storage, and potential for environmental damage, as well as damage to engines with which these materials come in contact. Service data shows that aircraft which operate out of airports in northern climate regions which use winter time sanding suffer accelerated deterioration rates. Engine teardowns show that sand erosion is the primary cause of wintertime performance deterioration, including such problems as eroded fan and compressor airfoil and eroded blade tip seals. Technology trends dictate that sand ingestion must be reduced in the future.

Although a variety of mechanical devices have been suggested for abrading icy surfaces, the present invention provides the convenience of using conventional, readily available rotary-type power lawn mowers. Other attachments for facilitating use of lawn mowers, other than for their normal grass-cutting operation, have been suggested, but none offer the specific features and advantages of the present invention.

Draughon, U.S. Pat. No. 2,863,162, discloses a conventional lawn mower which includes a horizontally rotatable blade transformable to a snow sweeper by application of brushes over the ends thereof. As described therein, this device would simply not provide the abrasive action necessary for increasing traction on icy surfaces.

Erickson, U.S. Pat. No. 2,983,057, discloses a blower head attachment for converting a conventional rotary lawn mover into a snow removal machine. The attachment is a blower head at the forward end thereof with an upright plate having a front blower or pusher face. Again, this device provides snow removal only, without providing increased traction on icy surfaces.

Stoddard, U.S. Pat. No. 2,984,919, discloses a snow removal attachment for a conventional rotary lawn mower with a special rotary support which uses a blower rather than conventional fan action. Here also, no provision is made for increasing traction on icy surfaces.

Beckner, U.S. Pat. No. 3,775,878, describes a snow removal attachment device for rotary-type mowers. The attachment device is a resilient, snow-engaging wiper-type member inclined at an angle rearwardly away from the direction of rotation, so that the trailing end wipes against the ground surface while resiliently avoiding rocks and surface irregularities. This device also is not suitable for improving traction on icy surfaces.

Blackstone, U.S. Pat. No. 4,409,781 describes a thatching tool for attachment to a rotary lawn mower. The tool includes a rotatable supporting bar to be rotated by a motor of the mower with the bar having thatching teeth mounted at both ends. Although this device bears some similarity to the ice scarifying attachment of the present invention, it does not offer the particular design and materials necessary for extended, rigorous use on demanding ice covered surfaces.

Bokon, U.S. Pat. No. 4,719,743, describes a lawn mower which can also function as a winter snow thrower. To function as a snow thrower, a sprocket chain is replaced by a gear train to connect the gear box to the sprocket. A short sheet metal ramp is added which scoops up the snow and lifts it to the level of the transverse cutting bar to direct the scooped snow into the cutting zone of the rotary cutter assembly. The rotary cutter assembly loosens the snow and the blower discharges the snow away from the path of the machine. This device is not adapted for improving traction on ice covered traffic surfaces.

SUMMARY OF THE INVENTION

This invention provides an ice scarifying tool adapted to be removably attached to a drive shaft of a rotary-type power lawn mower, so that the tool rotates in a plane substantially parallel to an icy ground surface. The tool comprises a support plate, which may be formed in various different shapes. One suitable shape is a substantially rectangular elongate bar having two long edges, two terminal ends and a central shaft mounting means. The two long edges form leading and trailing edges, respectively, at each end with respect to the direction of rotation of the bar. Each terminal end has at least a pair of cutouts to form a central retaining flange. An ice scarifying finger is provided at each flange of the support plate. The finger has a resilient coil portion received over a corresponding retaining flange. A locking bolster may be fitted across each of the terminal ends, both to securely retain the finger in place and to provide rigidity to the bar. A second attachment means at a proximal end of the finger is provided to attach the finger to the support plate and maintain secure positioning of the finger in ground contact, when the ice scarifying tool is operated over hard, demanding icy traffic surfaces. An ice scarifying carbided tip at the distal end of the finger extends groundward from the support plate.

Alternatively, the support plate may be in the shape of a circular disk with a central shaft mounting means and a plurality of cutouts forming planar retaining flanges as described above. The support plate may also be a planar cruciform with a central shaft mounting means with cutouts forming planar retaining flanges positioned at the four ends of the cruciform. Each flange supports an ice scarifying finger as previously described.

When the support plate is circularly horizontally rotated by the motor while the lawn mower is directed over an icy surface, the ice scarifying tip is urged into resilient contact with the surface, thereby chipping and scarifying the icy surface to improve traction thereon. A bag attachment or auxiliary blower may be provided for removal of the chipped ice, or it may be removed by power sweeper or plow.

DETAILED DESCRIPTION OF A PREFERRED EMBODIMENT

Figure 1:
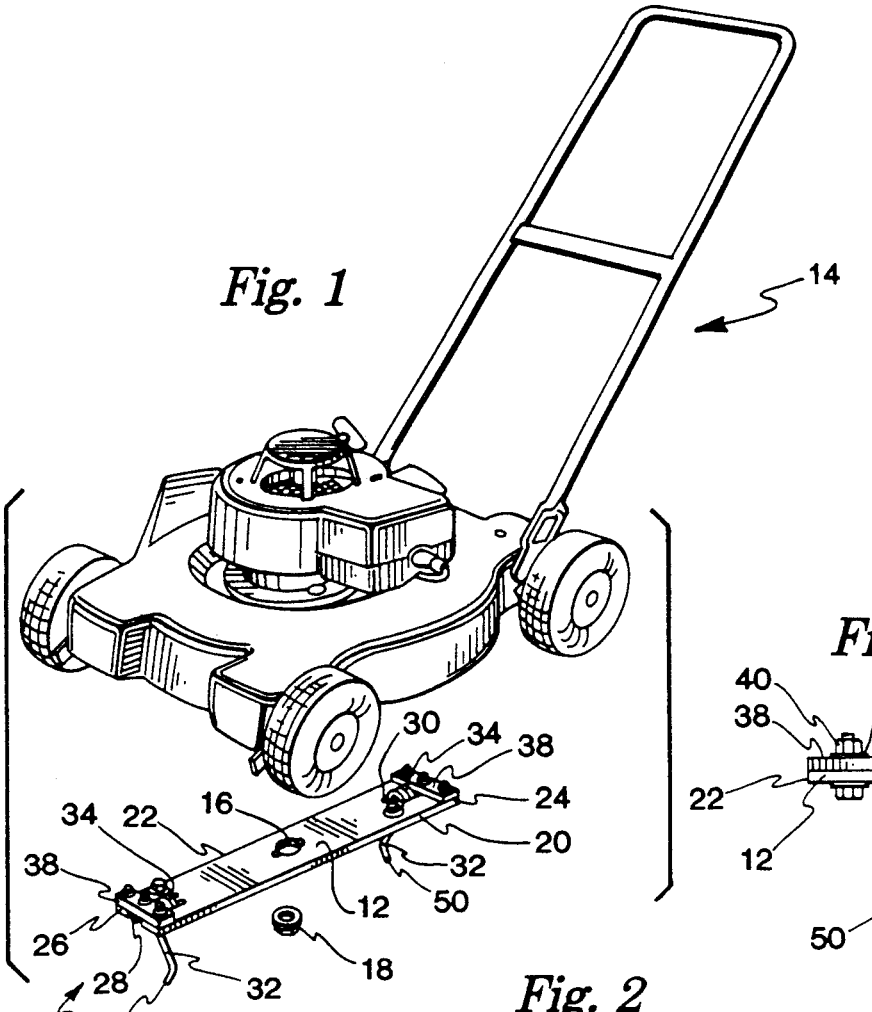
FIG. 1 is an exploded perspective view of a common rotary-type power lawn mower and an ice scarifying tool of the present invention, with the support plate in the form of an elongate bar.
Figure 3:
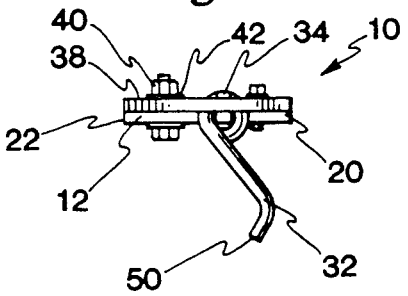
FIG. 3 is an end elevational view thereof.

An ice scarifying tool 10 of the present invention is shown in FIGS. 1–4, wherein the support plate is in the form of an elongate bar 12. FIG. 1 shows the tool 10 in association with a rotary-type power lawn mower 14, with which the tool 10 is adapted to be used as an ice scarifying attachment, by attaching the central shaft mounting hole 16 to the drive shaft (not shown) of the lawn mower 14 by conventional mounting means, such as the mounting nut 18. The bar 12 has two long edges 20 and 22 and two terminal ends 24 and 26. The two long edges 20 and 22 form leading and trailing edges, respectively, at each end 24 and 26 with respect to the direction of rotation of the bar 12. Each of the two terminal ends 24 and 26 of the support bar 12 has a pair of cutouts to form retaining flanges 28 and 30 preferably positioned closer to each trailing edge than to each leading edge. Typical illustrative measurements for a tool 10 of the present invention would be about 20 inches long, ¾ inch thick, and 3 inches wide, and would typically be formed of heat treated steel.

Figure 5:
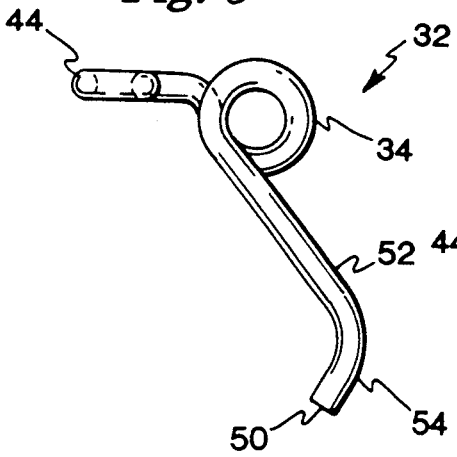
FIG. 5 is an end elevational view of a single scarifying finger.
Figure 6:
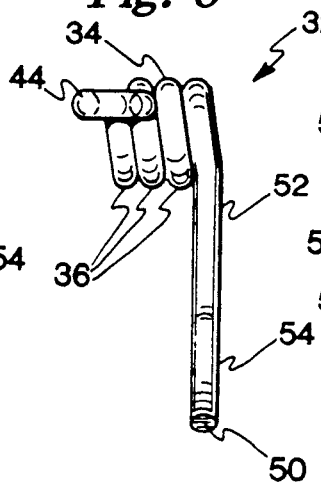
FIG. 6 is a front elevational view of a single scarifying finger.
Figure 7:
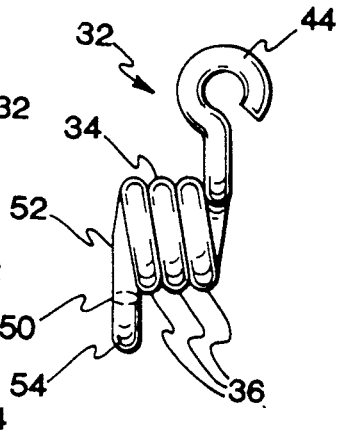
FIG. 7 is a top plan view of a single scarifying finger.

An ice scarifying finger 32, as illustrated in FIGS. 5–7, is mounted at either terminal end 24 and 26 of the support bar 12, as shown in FIGS. 1–4. The finger 32 has an intermediate resilient coil section 34 formed with a plurality of closely adjacent coils 36 in a horizontal alignment. The internal diameter of the coils 36 is sized to permit them to be closely accommodated on the retaining flanges 28 and 30. A locking bolster 38 fits across each of the terminal ends 24 and 26 secured by bolts 40 and lock washers 42, both to securely retain the finger 32 in place and to provide rigidity to the elongate bar 12. A second attachment means, shown as loop 44, is provided at the distal end of each finger 32 for attachment to the support bar 12, as by the fastening bolt 46 and ring eye 48, to maintain secure positioning of the finger 32 in ground contact, when the ice scarifying tool 10 is operated over hard, demanding icy traffic surfaces.

At the distal end of each finger 32 is a carbided ice scarifying tip 50 extending from the coil section 34 toward the respective trailing edge of the support bar 12. The tip 50 has a straight section 52 and a bent section 54 at the distal end. The optimum angle and measurements of the various portions of the ice scarifying finger 32 are to be determined by experimentation under actual ice usage conditions. The finger is preferably formed of spring steel with a carbided tip.

When the ice scarifying attachment of the present invention is thus attached to a conventional rotary-type lawn mower, the configuration of the ice scarifying finger 32 permits it to be urged into firm yet resilient contact with icy surfaces, thereby chipping and scarifying the icy surface to improve traction thereon.

Figure 8:
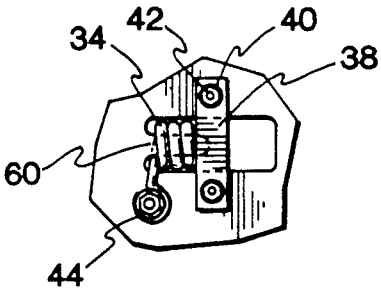
FIG. 8 is top plan view of an alternate arrangement for mounting a scarifying finger on the support plate.
Figure 9:
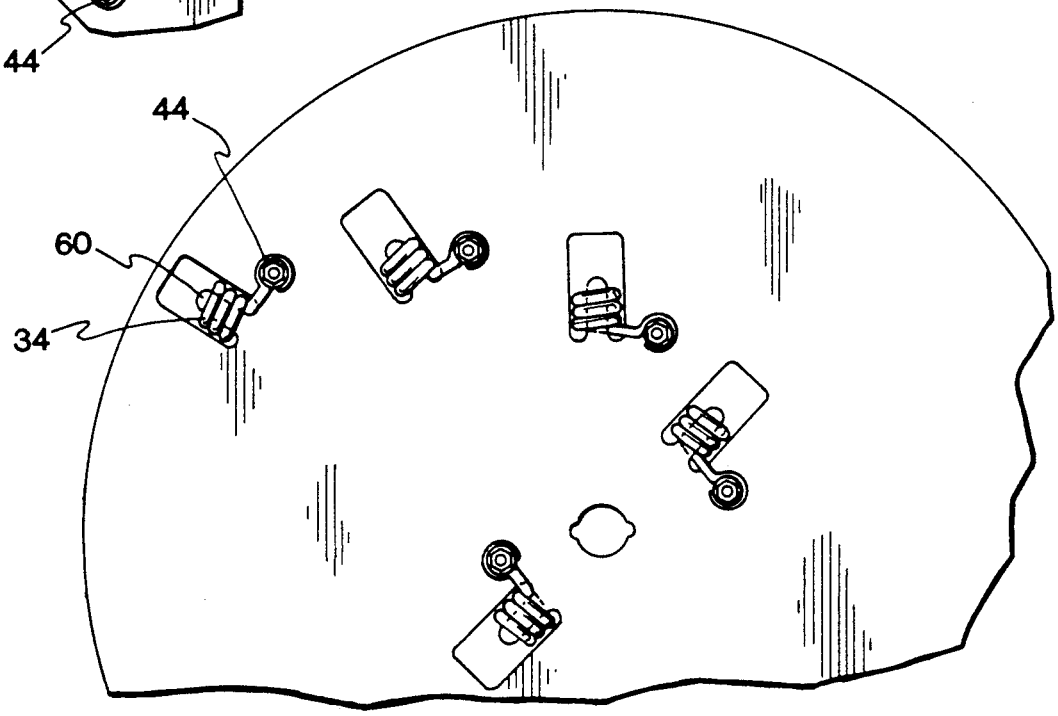
FIG. 9 is a top plan view of an alternate ice scarifying tool of the present invention, with the support plate in the form of a disk.

As illustrated in FIGS. 8 and 9, an ice scarifying tool 56 according to this invention can alternatively be formed with the support plate in the form of a circular disk 58. A plurality of generally U-shaped cutouts are provided in disk 58 to form planar retaining flanges 60. Preferably, as shown, the flanges 60 are formed in pairs, with the members of each pair positioned diametrically opposite each other and radially equidistant from each other, to facilitate rotational balancing of the ice scarifying tool 56 in use. The ice scarifying fingers 32 for use with this alternative ice scarifying tool 56 are the same as previously described, with attachment of the proximal attaching loop 38 to the upper surface 62 of the disk 58 and the carbided ice scarifying tip 50 projecting groundward from the ground facing surface 64 of the disk 58. If required, a locking bolster may be provided to fit across each of the flanges 60, as shown in FIG. 8 in the manner described above with reference to locking bolsters 38, both to securely retain the finger 32 in place and to provide rigidity to the disk support plate 58.

Figure 10A:
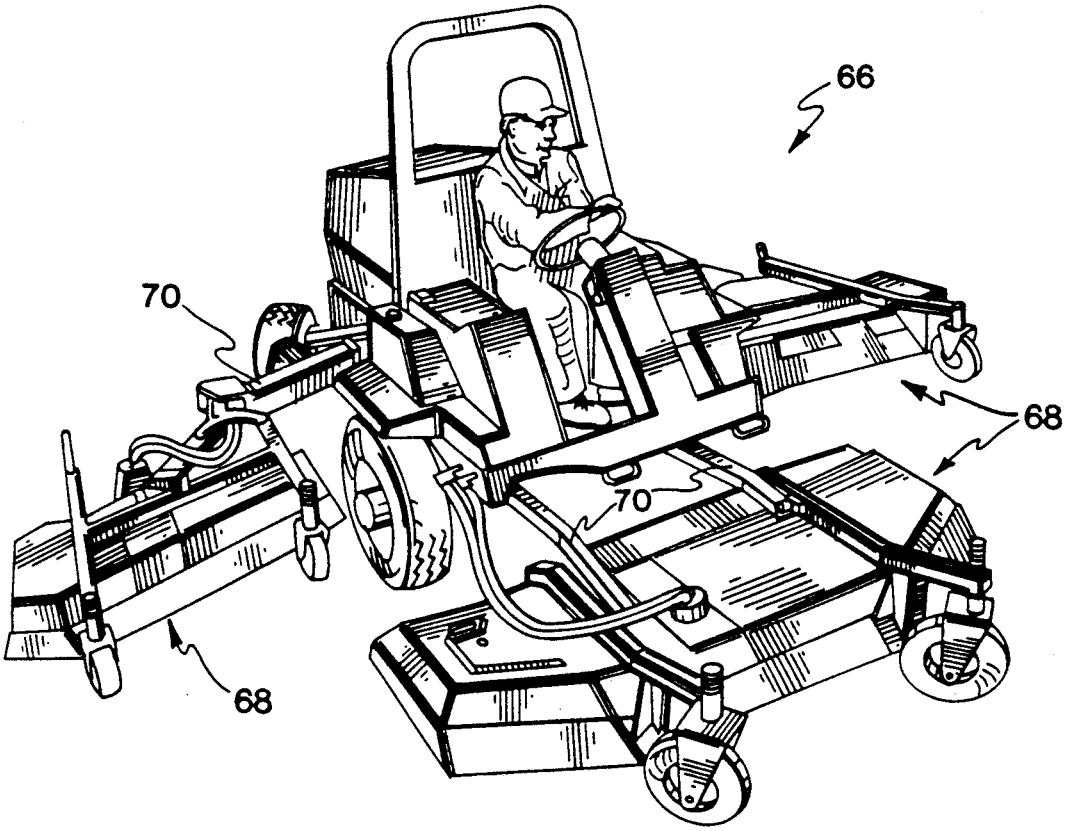
FIG. 10*a* is a grounds maintenance rotary-type rotary lawn mower for use with the ice scarifying tool of the present invention.
Figure 10B:
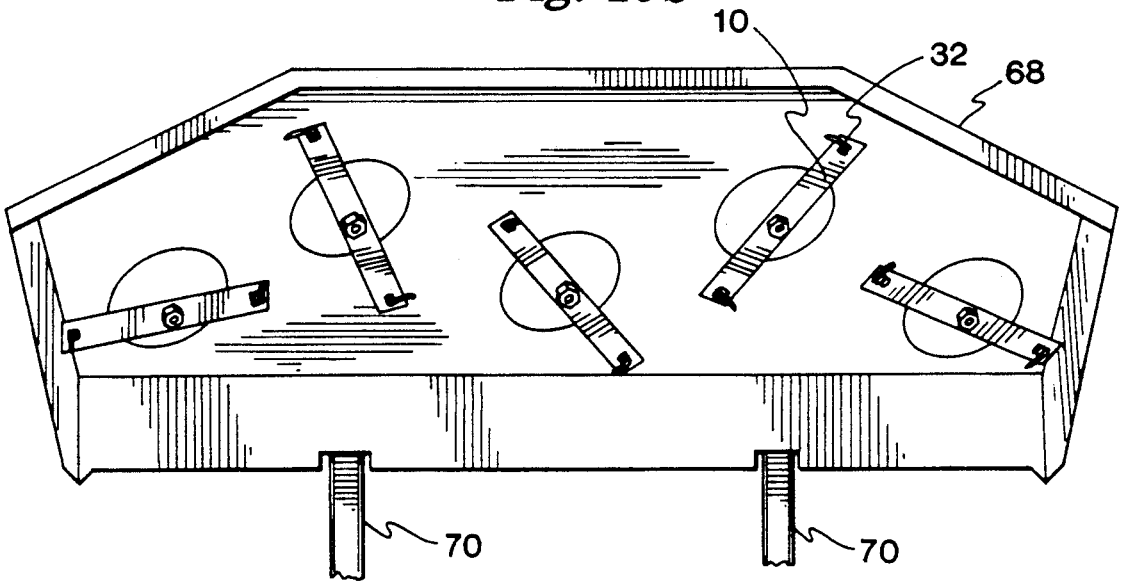
FIG. 10*b* a view of the underside of a typical gang assembly of the mower of FIG. 10*a*.

FIGS. 10*a* and 10*b* show a typical grounds maintenance rotary-type rotary lawn mower 66 for use with the ice scarifying tool 10 of the present invention. Such type of grounds maintenance type mowers 66 are readily commercially available. The mower 66 has a plurality of gang assemblies 68 secured to the mover 66 by booms 70. FIG. 10*b* shows the underside of a typical gang assembly 68 with a plurality of ice scarifying tools 10 of the present invention attached thereto in the manner previously described. Such grounds maintenance type mowers 66 are preferred for use in ice control on large outdoor surfaces, such as airport runways, parking lots, etc.

Figure 2:
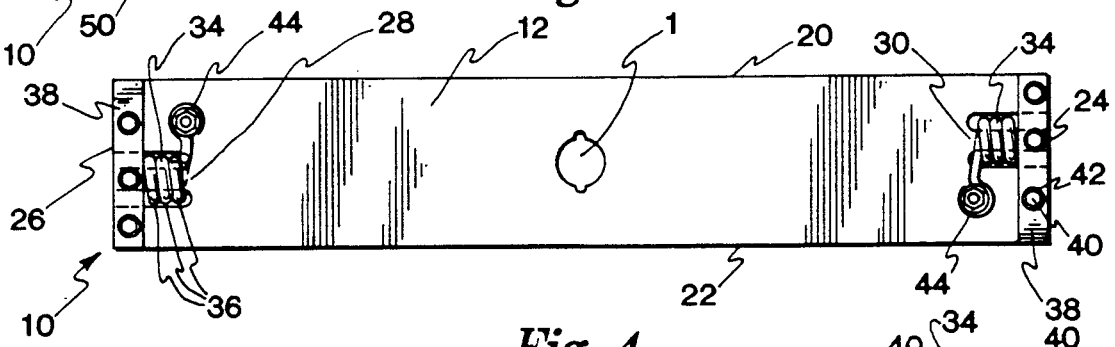
FIG. 2 is a top plan view of an ice scarifying tool present invention.
Figure 4:
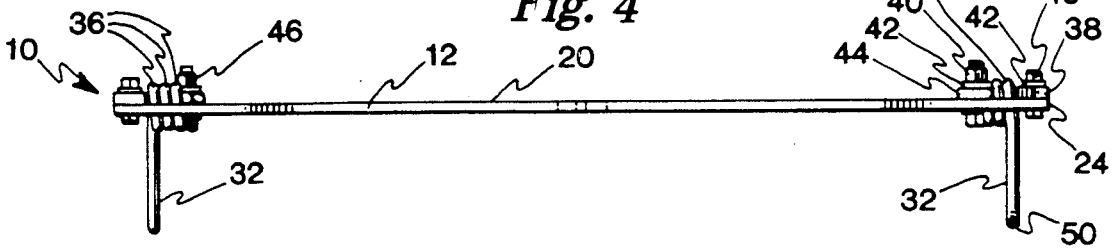
FIG. 4 is a side elevational view thereof.
Figure 11:
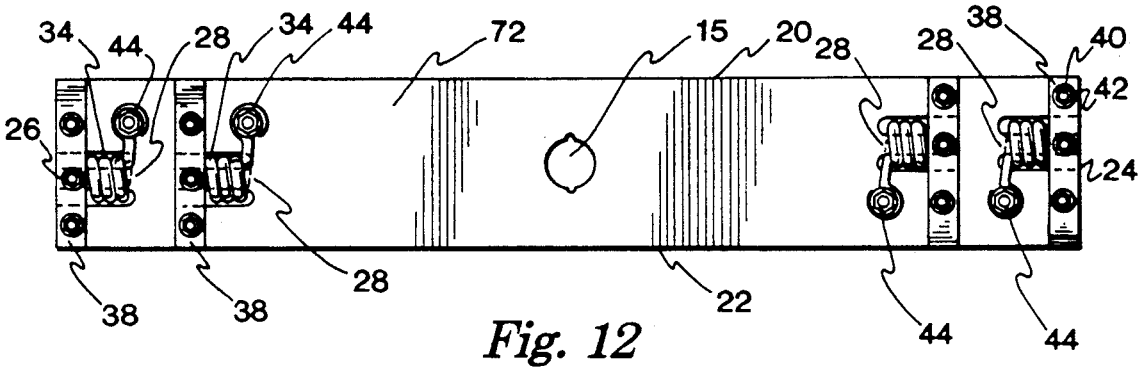
FIG. 11 is a top plan view of an ice scarifying tool similar to that of FIG. 2, supporting a plurality of ice scarifying fingers.
Figure 12:
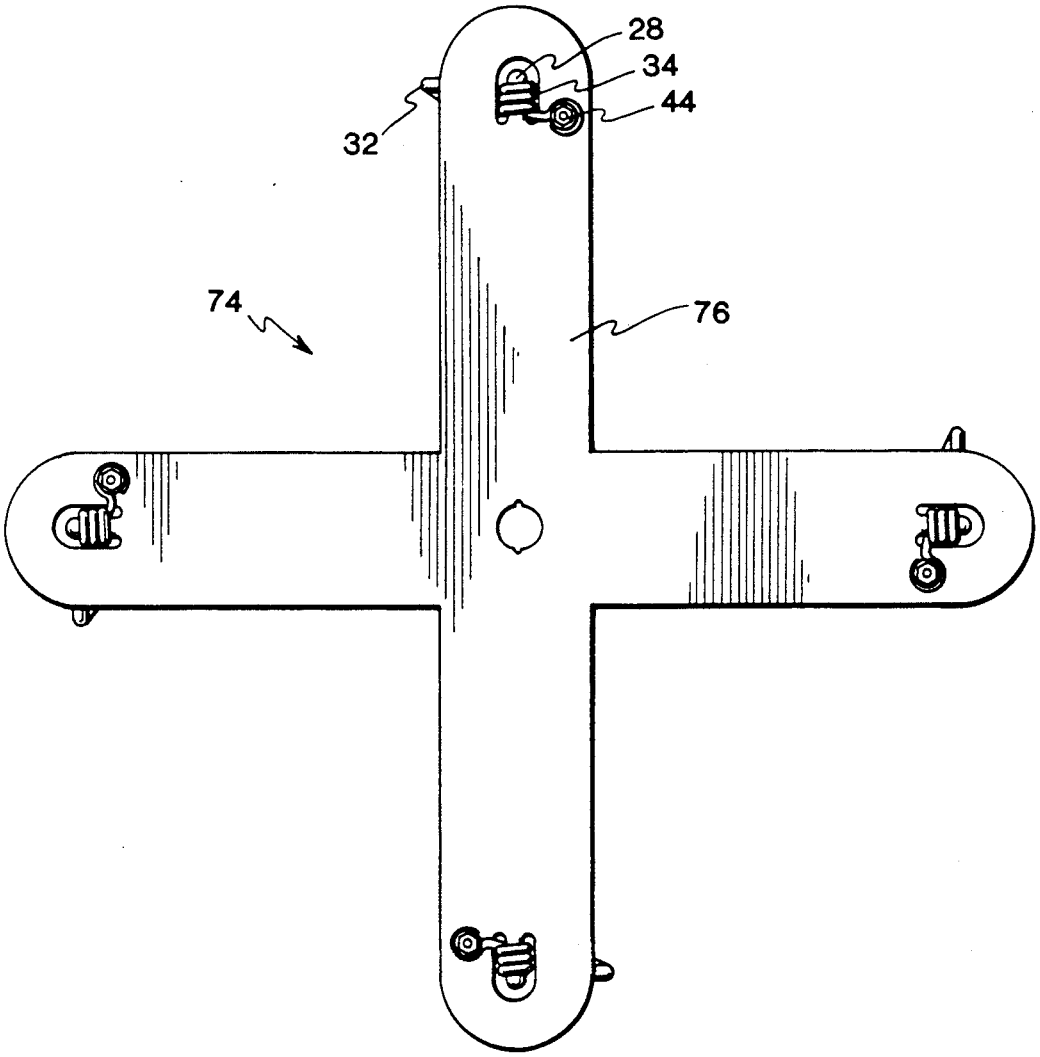
FIG. 12 a top plan view of an alternate ice scarifying of the present invention, with a cruciform support plate.

FIG. 11 shows a top plan view of an alternative ice scarifying tool 72 similar to that of FIG. 2, supporting a plurality of ice scarifying fingers 32. It is to be understood that any number of scarifying fingers 32 may be used, with it being preferred that the fingers 32 be of even number and equally spaced from each other. FIG. 12 shows a top plan view of an alternate cruciform ice scarifying tool 74 of the present invention, with a cruciform support plate 76 with ice scarifying fingers 32 located at the terminal ends of the plate 76.

It is to be understood that the chipped ice may if desired be blown from the scarified surface, bagged by the mower or otherwise removed to prevent subsequent melting and refreezing.

What is claimed is:

1. An ice scarifying tool adapted to be removably attached for rotational engagement by a drive shaft of a rotary-type power lawn mower, whereby said tool is designed and adapted to rotate in a plane substantially parallel to an icy ground surface, said tool comprising:

a substantially rectangular elongate support bar having two long edges and two terminal ends, the two long edges forming leading and trailing edges, respectively, at each end with respect to said direction of rotation, each terminal end having a pair of cutouts to form a central retaining flange positioned closer to each said trailing edge than to each said leading edge; and an ice scarifying tooth at each end of said support bar, each of said teeth having a resilient coil portion received over a corresponding retaining flange, attachment means at a proximal end of said tooth to be attached to said support bar, and an ice scarifying tip at the distal end of said tooth extending groundward from said support bar.

2. A disc shaped ice scarifying tool adapted to be removably attached to a drive shaft of a rotary-type power lawn mower, whereby said tool is adapted to rotate in a plane substantially parallel to a ground surface, said tool comprising:

a substantially circular support plate with a central shaft mounting means and a plurality of U-shaped cutouts forming planar radial retaining fingers; and a plurality of ice scarifying teeth, each tooth having a resilient coil portion received over one of said retaining fingers, attachment means at a proximal end of each tooth to be attached to said support plate, and an ice scarifying tip at the distal end of each tooth extending groundward from said support plate.

3. An ice scarifying tool according to claim 2, wherein said fingers are a plurality of pairs of fingers, each pair positioned diametrically opposite each other and radially equidistant from the disk center, such that no two fingers are positioned on a same radial line.

4. An ice scarifying tool according to claim 2, wherein the plate has an upper and a ground facing surface and attachment of the proximal end of each tooth is to the upper surface and the ice scarifying tip projects groundward from the ground facing surface.

5. In an ice scarifying device including a rotary-type power lawn mower having a wheeled housing for movement over an icy surface, the housing supporting a motor by means of a depending drive shaft, an ice scarifying attachment removably mounted on a lower end of the drive shaft, said ice scarifying attachment comprising:

a support plate with a central mounting means for operative connection to the motor drive shaft for circular rotation thereby in a plane parallel to the icy surface and retention means on said support plate for retaining depending fingers at at distance from said central mounting means, wherein said support plate is a planar disc or a planar cruciform;

each finger formed with a proximal end and a distal end, the distal end formed with an ice scarifying tip, and a resilient coil portion intermediate said distal and proximal ends, said resilient coil portion received on the support plate by said retention means;

such that when the support plate is circularly rotated by the motor while the lawn mower is directed over an icy surface, the ice scarifying tip is urged into resilient contact with the surface, thereby chipping and scarifying the icy surface to improve traction thereon.

6. An ice scarifying device according to claim 5, wherein the proximal end of such finger is provided with means for secure attachment to said support plate.

7. An ice scarifying device according to claim 5, wherein the support plate is a planar disc.

8. An ice scarifying device according to claim 5, wherein the support plate is a planar cruciform.

* * * * *